US009234253B2

(12) United States Patent
Warnecke et al.

(10) Patent No.: US 9,234,253 B2
(45) Date of Patent: Jan. 12, 2016

(54) METHOD FOR PRODUCING A FLAT STEEL PRODUCT WHICH CAN BE READILY FORMED, FLAT STEEL PRODUCT AND METHOD FOR PRODUCING A COMPONENT FROM SUCH A FLAT STEEL PRODUCT

(75) Inventors: Wilhelm Warnecke, Hamminkeln (DE); Manfred Meurer, Rheinberg (DE); Jens Kondratiuk, Buchs SG (CH); Marc Blumenau, Hagen (DE); Martin Norden, Essen (DE); Thiemo Wuttke, Recklinghausen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 651 days.

(21) Appl. No.: 13/513,682

(22) PCT Filed: Dec. 3, 2010

(86) PCT No.: PCT/EP2010/068831

§ 371 (c)(1),
(2), (4) Date: Sep. 19, 2012

(87) PCT Pub. No.: WO2011/069906

PCT Pub. Date: Jun. 16, 2011

(65) Prior Publication Data

US 2013/0180305 A1 Jul. 18, 2013

(30) Foreign Application Priority Data

Dec. 10, 2009 (DE) ..... 10 2009 044 861

(51) Int. Cl.
*C21D 1/26* (2006.01)
*C21D 1/76* (2006.01)

(Continued)

(52) U.S. Cl.
CPC *C21D 1/26* (2013.01); *B21D 31/00* (2013.01); *C21D 1/76* (2013.01); *C21D 8/0257* (2013.01);

(Continued)

(58) Field of Classification Search
CPC ..... C21D 1/26; C21D 1/76; C21D 8/0257; C21D 9/46; C22C 38/02; C22C 38/04; C22C 38/06; C22C 38/28; C22C 38/38; B21D 31/00
USPC ..... 148/284, 529, 320, 533; 72/362, 364
See application file for complete search history.

(56) References Cited

U.S. PATENT DOCUMENTS 7,687,152 B2 3/2010 Ikematsu et al.
8,394,213 B2 * 3/2013 Meurer et al. ..... 148/533

(Continued)

FOREIGN PATENT DOCUMENTS

DE 2105218 A1 12/1971
DE 102007061489 A1 6/2009

(Continued)

*Primary Examiner* — Helene Klemanski
(74) *Attorney, Agent, or Firm* — The Webb Law Firm

(57) ABSTRACT

A readily formable flat steel product has a ductile edge layer that is from 10 to 200 μm thick and has a ductility greater than a ductility of an inner core layer of the flat steel product. The readily formable flat steel product is produced by annealing a flat steel product having a C content of from 0.1 to 0.4% by weight in a continuous furnace. The annealing is carried out under an annealing atmosphere that contains from 0.1 to 25% by vol. of $H_2$ and $H_2O$, with the balance being $N_2$ and technically unavoidable impurities. A dew point is between −20° C. and +60° C., and a ratio of $H_2O/H_2$ is a maximum of 0.957. In the course of the annealing, the flat steel product is heated to a holding temperature of from 600 to 1100° C. and for a holding time of from 10 to 360 seconds.

18 Claims, 2 Drawing Sheets

(51) Int. Cl.

| | |
|---|---|
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/38*** | (2006.01) |
| ***B21D 31/00*** | (2006.01) |
| ***C21D 8/02*** | (2006.01) |

(52) U.S. Cl.
CPC . *C21D 9/46* (2013.01); *C22C 38/02* (2013.01); *C22C 38/04* (2013.01); *C22C 38/06* (2013.01); *C22C 38/28* (2013.01); *C22C 38/38* (2013.01)

(56) References Cited

U.S. PATENT DOCUMENTS

| | | | | |
|---|---|---|---|---|
| 2008/0083477 | A1* | 4/2008 | Drillet et al. | 148/242 |
| 2010/0304183 | A1* | 12/2010 | Honda et al. | 148/533 |
| 2010/0319812 | A1 | 12/2010 | Bian et al. | |
| 2011/0076477 | A1 | 3/2011 | Brandstatter et al. | |
| 2012/0125491 | A1 | 5/2012 | Meurer et al. | |
| 2013/0206284 | A1* | 8/2013 | Norden et al. | 148/217 |

FOREIGN PATENT DOCUMENTS

| | | | |
|---|---|---|---|
| DE | 102009018577 | B3 | 7/2010 |
| EP | 1612288 | A1 | 1/2006 |
| EP | 1980638 | A1 | 10/2008 |
| GB | 1189464 | | 4/1970 |
| JP | 60159120 | A | 8/1985 |
| JP | 2000-290730 | A | 10/2000 |
| JP | 200126853 | A | 1/2001 |
| JP | 2005-273001 | A | 10/2005 |
| JP | 2009249732 | A | 10/2009 |
| JP | 2009263752 | A | 11/2009 |
| WO | 2004090187 | A1 | 10/2004 |
| WO | 2009024472 | A1 | 2/2009 |

* cited by examiner

METHOD FOR PRODUCING A FLAT STEEL PRODUCT WHICH CAN BE READILY FORMED, FLAT STEEL PRODUCT AND METHOD FOR PRODUCING A COMPONENT FROM SUCH A FLAT STEEL PRODUCT

BACKGROUND OF THE INVENTION

1. Field of the Invention

The invention relates to a method for producing a flat steel product which can be readily formed and which has a C content of from 0.1 to 0.4% by weight, wherein the flat steel product is subjected to an annealing treatment in a continuous furnace.

The invention further relates to a correspondingly produced flat steel product and a method for producing components from such a flat steel product.

2. Background of Related Art

Flat steel products of the type in question in this instance are required in particular for the production of bodywork and chassis components for motor vehicles. In this instance, extremely high demands are placed on the flat steel products in terms of their forming properties. This relates to both cold and hot-formability.

The hot forming of galvanised flat steel products to form high-strength or extremely high-strength steel components is particularly problematic. With such steel components, the protective coating which is generally based on zinc or a zinc alloy provides sufficient cathodic corrosion protection.

However, if a steel sheet which is provided with a metal corrosion protection coating, for the hot forming and hardening operation which may be carried out subsequently or in combination with the hot forming, must be heated to a temperature which is above the melting temperature of the metal of the protective coating, there is a danger of so-called "liquid metal embrittlement". This embrittlement of the steel occurs when molten metal of the coating enters the notches which are formed on the surface of the respective flat steel product during forming. The liquid metal which reaches the steel substrate is precipitated there at the grain boundaries and thus reduces the maximum tensile and compressive stresses which can be taken up.

The danger of liquid metal embrittlement with higher-strength and high-strength steels which have only limited ductility and which consequently have a tendency to form cracks near the surface when they are formed has been found to be particularly critical.

From JP 60-159120 A it is generally known that the bending properties of a steel sheet can be improved by means of a decarbonisation treatment, by means of which there is produced an edge layer which is close to the surface, is from 20 to 100 μm thick and has a reduced C content with respect to the core region of the steel sheet. However, this measure in this prior art has no connection to steel sheets which are covered with a metal protective coating, nor does it relate to higher-strength steels or high-strength steels with C contents of at least 0.1% by weight.

The tendency for decarbonisation of a carbon-containing steel alloy results from the oxidation behaviour of the carbon released. Owing to its great movability, the carbon which is released in the lattice has a tendency towards effusion during a heat treatment. The decarbonisation which takes place depending on the C-potential of the gas phase, under which the heat treatment takes place, with or without simultaneous scaling, therefore represents one of the oldest problems in the production and processing of steel.

In principle, a decarbonisation is carried out in accordance with the Boudouard equilibrium reactions in accordance with the following reaction processes:

$$[C]+\tfrac{1}{2}O_2 \leftrightarrow CO$$

$$[C]+O_2 \leftrightarrow CO_2$$

$$[C]+CO_2 \leftrightarrow 2CO$$

$$[C]+H_2 \leftrightarrow CH_4$$

where [C]=carbon released

In commercial annealing installations having a typical protective gas atmosphere which contains hydrogen, nitrogen and water vapour, the following equilibrium reaction is produced:

$$H_2+\tfrac{1}{2}O_2 \leftrightarrow H_2O$$

Gas atmospheres containing water have been found to be particularly reactive with respect to carbon. Therefore, an additional heterogeneous equilibrium reaction which is particularly significant in practice supplements the decarbonisation reactions mentioned:

$$[C]+H_2O \leftrightarrow CO+H_2$$

When used in a selective manner, properties of a steel product determined by means of a decarbonisation can be improved.

In order to be able to use this knowledge effectively in practice, the "Open Coil" method is proposed in GB 1 189 464. In this method, a hard-rolled, cold-rolled strip is wound so loosely to form a coil that a free space is provided in each case between the individual winding layers of the coil. The annealing gas which flows through the free spaces during the subsequent annealing treatment in a hood type furnace then flows over the entire steel surface in a uniform manner so that a uniform decarbonisation result is achieved over the entire length of the processed steel strip. However, the annealing treatment which is carried out in this manner takes several hours.

A method which can be carried out more economically for decarbonisation annealing of steel strip in a continuous furnace under a reducing annealing atmosphere is described in DE-OS 2 105 218. According to this known method, the respective steel strip is annealed at an annealing temperature of less than 780° C. over a sufficiently long annealing period until the carbon content in the steel strip is less than 0.01% when leaving the continuous furnace. Subsequently, the steel strip can be provided with a hot-dip coating in order to improve its corrosion resistance. The sheet steel which is produced in this manner has particularly good formability. However, its strength values do not meet the demands which are regularly placed nowadays on flat steel products, from which components for motor vehicle bodywork are intended to be formed.

A suggestion known from WO 2009/024472 A1 also referred to the "Open Coil" method according to which there has been proposed, for a steel strip which comprises a tool steel and which is intended in particular for the production of cutting tools and the like and which has a C content of at least 0.4% by weight, a decarbonisation of the edge layer in order to combine a high level of hardness with good formability. In the region of the decarbonised edge layer, the steel strip which is processed accordingly has increased formability with respect to the base material, whereby the danger of brittle fracture with high external load is reduced.

In contrast to the applications considered in WO 2009/024472 A1, the person skilled in the art, with high-strength and extremely high-strength steels which are intended for the production of high-strength components, generally seeks to avoid, if possible, the decarbonisation or edge decarbonisation which is caused by annealing. It is generally considered that the decarbonisation has a negative influence on the mechanical material properties which are important for these applications.

Following this notion, there has been proposed in DE 102007061489 A1 a method wherein a ductile edge layer which is advantageous for forming is produced on a steel sheet by carrying out selective oxidation of the hardening alloy elements. Any decarbonisation is selectively counteracted in this instance.

SUMMARY OF THE INVENTION

Against the background of the prior art explained above, an object of the invention was to set out a method which allows a readily formable, high-strength or extremely high-strength flat steel product to be produced in an economical manner. Furthermore, a flat steel product which is particularly suitable for hot or cold forming and methods for producing components from such a flat steel product was intended to be set out.

The method according to the invention for producing a readily formable flat steel product which has a C content of from 0.1 to 0.4% by weight, in particular less than 0.4% by weight, is based on the notion of subjecting the relevant flat steel product in a continuous furnace to an annealing treatment in which the edge layers are decarbonised. To this end, the annealing treatment is carried out according to the invention under an annealing atmosphere which contains from 0.1 to 25% by vol. of $H_2$, $H_2O$, with the balance being $N_2$ and technically unavoidable impurities. The dew point of the annealing atmosphere is in the range from −20° C. to +60° C. At the same time, in the annealing atmosphere, the relationship $H_2O/H_2$ is intended to be adjusted to a maximum of 0.957 in order to achieve an optimal decarbonising effect.

In the course of the annealing treatment, the flat steel product is further heated according to the invention to a holding temperature which is from 600 to 1100° C. and at which it is held for a holding time which is from 10 to 360 seconds under the atmosphere which is composed according to the invention.

As a result, the flat steel product which is obtained after the annealing treatment according to the invention has a ductile edge layer which is from 10 to 200 μm thick and which adjoins its free surface and which has a ductility greater than the ductility of the inner core layer of the flat steel product that is covered by the edge layer. Contrary to the conviction in existence in the prior art, the invention succeeds in adjusting the desired combination of properties comprising high strength and good formability in a steel sheet which contains from 0.1 to 0.4% by weight of carbon, in particular up to 0.38% by weight of carbon, by means of an annealing treatment which results in edge decarbonisation of the steel material. This edge decarbonisation brings about ductilisation of the structural region near the surface, which ductilisation counteracts the failure of the material owing to cracks that is otherwise caused by forming.

Consequently, the invention is based on the notion of carrying out edge decarbonisation of hard-rolled flat steel products which are provided for cold forming or hot forming, that is to say, steel strips or steel sheets, in such a manner that the flat product obtained after the annealing treatment has a ductile edge region which is typically ferritic, near the surface and has a specific thickness at the first grain layers and which improves the forming properties of the steel product both for forming in the cold state and for forming in the hot state. In particular, the danger of formation of cracks or notches at the surface of the steel product is minimised in the case of forming thereof.

It is significant for the method according to the invention that, although the edge decarbonisation of the structure near the surface is able to occur at the same time as annealing conditioning of the steel surface for subsequent application of a corrosion protection layer, it has a decoupled reaction mechanism.

For instance, the edge decarbonisation of the structural region near the surface occurs in accordance with the following relationship:

$$[C]+H_2O \leftrightarrow CO+H_2$$

where [C]=carbon released, whereas the oxidation/reduction reaction of the surface occurs as follows:

$$x[Me]+yH_2O \leftrightarrow [Me_xO_y]+yH_2$$

where [Me]=respective metal x, y=stochiometric coefficients

Surprisingly, it is also possible to achieve the desired depth of decarbonisation with very short conditioning times when the annealing conditions set out according to the invention are applied. For instance, the method according to the invention is particularly distinguished in that it can be carried out in a particularly economical manner using a continuous furnace. This allows the method according to the invention to be introduced into continuously running production processes which require high band speeds, as is the case, for example, in hot coating installations in which steel strips are thermally processed with continuous travel and are hot-dip-coated with a corrosion protection coating.

Accordingly, a particularly advantageous configuration of the invention makes provision for the flat steel product to be coated with a metal protective layer after the annealing treatment. In this variant of the method according to the invention, the invention makes particular use of the recognition that the danger of liquid metal embrittlement can be minimised in that the temperature range which is susceptible to liquid metal embrittlement can be displaced by selective modification of the region of the flat steel product near the surface so that the temperature range does not overlap with the temperature range typical for hot forming.

In the event that the production method according to the invention precedes a subsequent hot-dip coating, the annealing treatment carried out according to the invention takes place at the same time as the surface conditioning for the downstream surface refinement by controlling the carbon effusion near the surface by means of a heterogeneous annealing gas/metal reaction.

It is particularly advantageous to use the method according to the invention in a hot-coating installation because the annealing treatment can in this case comprise the edge decarbonisation, surface conditioning and recrystallisation of the base material and the hot-dip coating can subsequently be carried out in a continuous method sequence in-line following the annealing treatment.

In the course of the surface refinement of a flat steel product produced according to the invention, which refinement is preferably carried out by hot-dip coating, coating systems which are known per se and which are based on Zn, Al, Zn—Al, Zn—Mg, Zn—Ni, Al—Mg, Al—Si or Zn—Al—Mg may be applied to the steel substrate.

Alternatively or additionally to the hot-dip refinement carried out in-line, a steel strip which has been provided with a ductile decarbonised edge layer in a continuous annealing system in a manner according to the invention can subsequently receive a metal, metal/inorganic or metal/organic coating in that it is coated electrolytically, for example, with a Zn, Zn—Ni or a Zn—Fe coating, by PVD or CVD deposition or by means of another metal/organic or metal/inorganic coating method.

According to a method variant which is particularly important in practice, consequently, the invention makes provision for the flat steel product to be hot-dip-coated in an operating step which is carried out continuously so as to follow the annealing treatment. The hot-dip coating can be carried out in a manner known per se as a hot coating, in particular hot galvanising. In order to ensure optimum adhesion of the coating to the steel substrate, oxidation of the surface of the flat steel product may be carried out before the hot coating.

In order to further optimise the mechanical properties, an excessive ageing treatment carried out conventionally may follow the annealing treatment according to the invention.

In accordance with what has been explained above, a flat steel product which is produced using a method according to the invention has a C content of from 0.1 to 0.4% by weight and a ductile edge layer which is from 10 to 200 μm thick and which has a ductility which is increased in relation to the core layer of the flat steel product.

The thickness of the ductile layer can be established in conventional manner in accordance with the procedure set out in DIN EN ISO 3887. Accordingly, the total decarbonisation depth is the spacing from the surface as far as the location at which the content of carbon corresponds to that of the non-influenced core region. A hardness which is not higher than 75% of the hardness of the core region, that is to say, Hv(decarbonised)/Hv(core region)=¾, is thereby adjusted in the region near the surface in the decarbonised edge layer region.

The ductile edge layer of a flat steel product according to the invention is typically distinguished by a ferritic structure at least near the free surface thereof. This applies to a multiple-phase base material in which a ferritic structure near the surface is adjusted in the region of the edge layer decarbonised according to the invention and equally well to a single-phase, typically ferritic steel, in which the decarbonisation according to the invention results in ductilisation of the ferrite near the surface.

A flat steel product produced according to the invention is equally suitable for cold and hot forming, the particular advantages thereof becoming evident particularly in the hot forming of steel sheets or strips which are provided with a metal protection layer, in particular a zinc-coating. The steels which are provided according to the invention for the cold forming typically have a tensile strength of from 500 to 1500 MPa. Steels which have a tensile strength of from 900 to 200 MPa after the hot forming can be used according to the invention for the hot forming.

In the event that a flat steel product according to the invention is intended to be formed by hot forming to form a component, the flat steel product according to the invention can first be heated according. to the invention to a heating temperature which is above its Ac1 temperature and subsequently be hot-formed to form the component.

If, for example, a hardening operation is intended to follow the hot forming, the flat steel product according to the invention can also be readily heated to a heating temperature which is at least equal to the Ac3 temperature of the flat steel product. Even at such a high heating temperature, the danger of embrittlement is also minimised in a flat steel product produced in accordance with the invention if the flat steel product is provided with a metal coating whose melting temperature is less than or equal to the heating temperature. The ductility of the edge layer obtained by the edge layer decarbonisation according to the invention prevents crack formation and thereby ensures that molten metal of the coating cannot become introduced into the core region of the steel substrate.

The method according to the invention consequently improves particularly the forming properties of high-strength/extremely high-strength flat steel products which are refined at the surface both for cold forming and for hot forming, with flat steel products according to the invention coated with a metal protective coating being suitable for hot forming in a particularly advantageous manner. This becomes possible in that, according to the invention, edge decarbonisation by means of which a ductile, typically ferritic edge layer is formed is induced by a selective annealing gas/metal reaction in a continuous furnace. This protects the solid, brittle base steel material from the progression of cracks extending from the surface during the forming operation.

BRIEF DESCRIPTION OF THE DRAWINGS

The invention is explained in greater detail below with reference to embodiments. In the drawings.

DETAILED DESCRIPTION OF THE PREFERRED EMBODIMENTS

In order to examine the effects obtained by the method according to the invention, hard-rolled cold strip samples of a multiple-phase steel "MP" and a steel "WU" conventionally used for hot forming have been produced, respectively. The compositions of steels MP and WU are set out in Table 1.

TABLE 1

| Steel | C | Mn | P | Si | V | Al | Cr | Ti | B | Nb |
|---|---|---|---|---|---|---|---|---|---|---|
| | [% by weight] | | | | | | | | | |
| MP | 0.22 | 1.7 | 0.02 | 0.1 | 0.00 | 1.7 | 0.06 | 0.1 | 0.005 | 0.001 |
| WU | 0.22 | 1.22 | 0.01 | 0.25 | 0.00 | 0.02 | 0.13 | 0.03 | 0.005 | 0.003 |

Balance: iron and unavoidable impurities

Two samples produced from the steels MP and WU have been subjected to an annealing treatment according to the invention in a continuous furnace for edge layer decarbonisation. The annealing parameters used are set out in the column "According to the invention" of Table 2 below.

For comparison, two additional samples produced from the steels MP and WU have been subjected to conventional annealing in the continuous furnace, as normally carried out in order to provide hot-dip galvanising.

In order to optimise the mechanical properties of the samples, an excessive ageing treatment was further carried out. This has no influence on the formation of the decarbonised edge layer, but was instead carried out purely optionally in order to improve the properties of the strip.

The parameters which are used in the excessive ageing treatment and which are identical for both tests are also set out in Table 2.

TABLE 2

| Operating step | According to the invention | Conventional |
|---|---|---|
| Annealing treatment | | |
| Heating rate | 10 K/s | 10 K/s |
| Holding temperature | 800° C. | 800° C. |
| Holding time | 120 s | 60 s |
| Annealing atmosphere | 5% $H_2$ 95% $N_2$ | 5% $H_2$ 95% $N_2$ |
| Dew point | +5° C. | −30° C. |
| Cooling rate after holding operation | 20 K/s | 20 K/s |
| Excessive ageing treatment | | |
| Temperature of the excessive ageing treatment | 480° C. | 480° C. |
| Duration of the excessive ageing treatment | 20 s | 20 s |
| Atmosphere of the excessive ageing treatment | 5% $H_2$ 95% $N_2$ | 5% $H_2$ 95% $N_2$ |
| Dew point | +5° C. | −30° C. |
| Cooling to ambient temperature | | |

Figure 1:
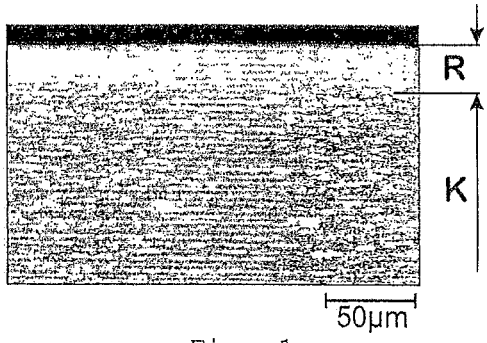
FIG. 1 shows a ground vertical section of a steel sample which has been decarbonised at the edge layer according to the invention.

FIG. 1 is the micrograph of the sample which is produced from the steel MP and processed by annealing according to the invention. It can clearly be seen that a decarbonised structural region (edge layer "R") near the surface has been adjusted as a result of the procedure according to the invention.

Figure 2:
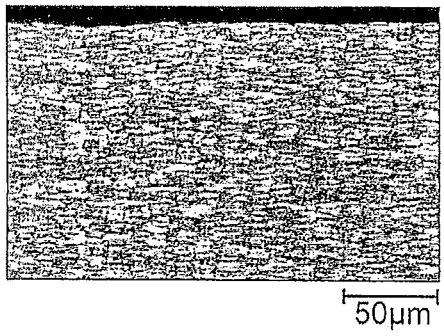
FIG. 2 shows a ground vertical section of a conventionally annealed sample for comparison.

However, the micrograph of the sample which is also produced from the steel MP but which has been subjected to conventional annealing treatment does not demonstrate any decarbonised region (FIG. 2).

Furthermore, GDOES measurements of the carbon content were carried out on the samples which are produced from the steel MP and which are processed by conventional annealing and annealing according to the invention. The GDOES measurement method ("GDOES"=Glow Discharge Optical Emission Spectrometer) is a standard method for rapidly detecting a concentration profile of coatings. It is described, for example, in the "VDI-Lexikon Werkstofftechnik" (VDI lexicon of materials technology), published by Hubert Gräfen, VDI-Verlag GmbH, Düsseldorf 1993.

Figure 3:
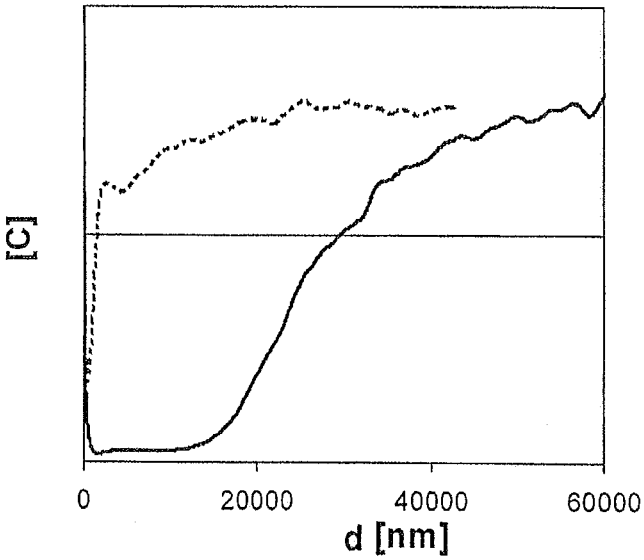
FIG. 3 shows GDOES depth profiles of the carbon content of the samples illustrated in FIGS. 1 and 2.

The result of the GDOES measurements is set out in FIG. 3, the broken line indicating the carbon distribution of the conventionally processed sample and the solid line indicating the carbon distribution of the sample processed according to the invention.

FIG. 3 also shows clearly that the sample processed according to the invention has a marked decarbonised edge layer R whose thickness is approximately 40 μm. However, such an edge layer is not present in the conventionally processed sample.

It was possible to demonstrate by means of microhardness measurements that the edge region R which is decarbonised in the sample which is produced from the steel MP and which is thermally processed according to the invention has a microhardness of 163 HV and the non-decarbonised core region K has a hardness of 255 HV. The % relationship $Hv_R/Hv_K$ comprising the hardness $Hv_R$ of the decarbonised edge region R relative to the hardness $Hv_K$ of the core region K was consequently 64% and was therefore clearly below the value of 75% set out for this relationship according to the invention.

Following the annealing, surface refinement of the samples was carried out, wherein zinc was applied to the samples electrolytically.

Subsequently, a three-point bending test was carried out on the coated samples both before and after pressure hardening.

Figure 4:
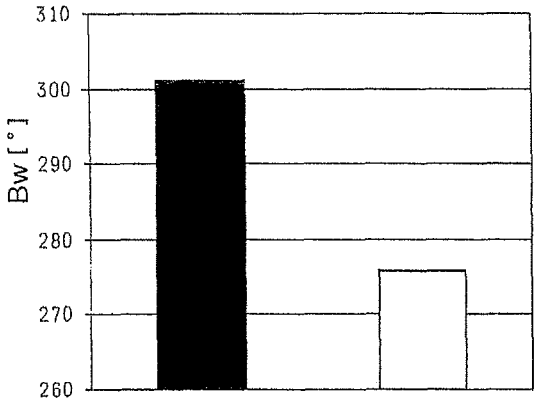
FIG. 4 shows the results of three-point bending tests with the samples illustrated in FIGS. 1 and 2.

The results of the tests are set out in FIG. 4 for the samples produced from the steel MP. The bending angle Bw of the sample produced according to the invention is indicated therein by the black bar and the bending angle Bw of the conventionally produced sample is indicated by the white bar. It is also clear in this instance that the samples produced and processed according to the invention have substantially better forming and bending properties than the conventionally processed samples.

Comparable results for the samples processed by annealing according to the invention and annealing in a conventional manner were able to be demonstrated for the galvanised and formed samples which are processed by annealing and produced from the steel WU.

The invention claimed is:

1. A method for producing a readily formable flat steel product that has an inner core layer and a ductile edge layer at a free surface of the flat steel product, wherein the ductile edge layer covers the inner core layer, wherein the ductile edge layer is from 10 to 200 μm thick, and wherein a ductility of the ductile edge layer is greater than a ductility of the inner core layer, the method comprising the steps of:

annealing a flat steel product having a C content of from 0.1 to 0.4% by weight in a continuous furnace, wherein the step of annealing is carried out under an annealing atmosphere that contains from 0.1 to 25% by vol. of a total amount of $H_2$ and $H_2O$, with the balance being $N_2$ and technically unavoidable impurities, wherein a dew point of the annealing atmosphere is between −20° C. and +60° C., and wherein a volume ratio of $H_2O/H_2$ of the annealing atmosphere is a maximum of 0.957; and in the course of the annealing, heating the flat steel product to a holding temperature of from 600 to 1100° C. and for a holding time of from 10 to 360 seconds.

2. The method according to claim 1, wherein the flat steel product is coated with a metal protective layer after the step of annealing.

3. The method according to claim 2, wherein the flat steel product is hot-dip-coated in a continuous operating sequence after the step of annealing.

4. The method according to claim 2, wherein the flat steel product is hot-coated after the step of annealing.

5. The method according to claim 4, wherein oxidation of the surface of the flat steel product is carried out before the flat steel product is hot-coated.

6. The method according to claim 2, wherein the flat steel product is coated with a metal/organic coating.

7. The method according to claim 3, wherein the flat steel product is coated with a metal/organic coating.

8. The method according to claim 2, wherein the flat steel product is coated with a metal/inorganic coating.

9. The method according to claim 3, wherein the flat steel product is coated with a metal/inorganic coating.

10. The method according to claim 1, wherein the C content of the flat steel product is less than 0.38% by weight.

11. A flat steel product having a C content of from 0.1 to 0.4% by weight and having an inner core layer and a ductile edge layer at a free surface of the flat steel product, wherein the ductile edge layer covers the inner core layer, wherein the ductile edge layer is from 10 to 200 μm thick, and wherein a ductility of the ductile edge layer is greater than a ductility of the inner core layer.

12. The flat steel product according to claim 11, wherein the ductile edge layer includes a ferritic structure.

13. The flat steel product according to claim 11, wherein the C content of the flat steel product is a maximum of 0.38% by weight.

14. The flat steel product according to claim 12, wherein the C content of the flat steel product is a maximum of 0.38% by weight.

15. The flat steel product according to claim 11, wherein a hardness (HV) of the ductile edge layer is a maximum of 75% of a hardness (HV) of the inner core layer of the flat steel product.

16. A method for producing a component from a flat steel product of claim 11, wherein the flat steel product is subjected to hot forming, in which the flat steel product is initially heated to a heating temperature above its Ac1 temperature and subsequently hot-formed to form the component.

17. The method according to claim 16, wherein the heating temperature is at least equal to the Ac3 temperature of the flat steel product.

18. A method for producing a component from a flat steel product of claim 11, wherein the flat steel product is cold-formed to form the component.

* * * * *